United States Patent [19]

Pollock

[11] Patent Number: 4,833,780

[45] Date of Patent: May 30, 1989

[54] PICK TOOL WITH SUPPORT

[76] Inventor: William J. Pollock, 20084 Peaceful Oak Rd., Sonora, Calif. 95370

[21] Appl. No.: 156,009

[22] Filed: Feb. 16, 1988

[51] Int. Cl.[4] ..... B26F 1/00

[52] U.S. Cl. ..... 30/368; 30/296 R

[58] Field of Search ..... 30/366, 368, 296 R, 30/323; 294/61, 126

[56] References Cited

U.S. PATENT DOCUMENTS 42,228 4/1864 Sanders ..... 30/368

FOREIGN PATENT DOCUMENTS 43699 6/1888 Fed. Rep. of Germany ..... 30/366

*Primary Examiner*—Douglas D. Watts

*Attorney, Agent, or Firm*—Georges A. Maxwell

[57] ABSTRACT

An improved pick tool for piercing, prying and moving small parts within assemblies of delicate and fragile parts. The pick includes an elongate, tubular lever arm with front and rear ends. A manually-engagable handle is related to the rear end of the arm and is shiftable axially relative thereto. An elongate shaft with a pointed front end and a rear end fixed to the handle is slidably engaged within the arm. A compression spring within the arm and engaging the shaft yieldingly holds the shaft and the handle in a rear unactuated position where the pointed front end portion of the shaft occurs within the forward portion of the arm. The handle and shaft are shiftable forwardly to an actuated position where the pointed front portion of the shaft projects freely forwardly from the arm. A tubular work-engaging bushing of soft, flexible and resilient plastic material projects forwardly from the arm and normally shrouds the pointed end of the shaft. An annular work-engaging fulcrum block of soft, resilient and flexible material is engaged about and projects radially from the arm. The fulcrum block is spaced from and between the handle and the front ends of the arm and shaft.

5 Claims, 2 Drawing Sheets

H
J
A
B
J
J
-T-
C
P
X
X
J
J
X 42
40
S
C
P
23
24
B
43

A
11
10
31
E
P
20
23
P
24
C
5

C
21
20
31
24
S
23
22
E

41
A
11
24
C
40
43
GUIDE ANGLES
5
42
H
ORIENTING AND REST SURFACES
FULCRUM

PICK TOOL WITH SUPPORT

PRIOR ART

The most pertinent prior art of which I am aware are the many small awl-like picking tools that are of great antiquity and which are well-known to all. The most pertinent of those tools are those awls which are characterized by spring-loaded, pointed, work-engaging shafts slidably engaged in tubular arms and which are specifically intended to peg or punch holes in related work and which are referred to as "pegging awls." But for the inclusion of a soft, flexible and resilient work-engaging bushing and a soft, resilient and flexible fulcrum block, the pick tool that I provide is structurally similar to certain spring-loaded pegging awls provided by the prior art.

BACKGROUND OF THE INVENTION

In the art of setting ceramic tile, flat, square or rectangular tile are fixed to a foundation or substraight by suitable cement. The tile are spaced apart to establish narrow, uniform channels between adjacent tile which are ultimately filled with grout (cement) to establish what is called "grout joints." To establish neat, uniform grout joints, it has long been common practice to insert small cruciform spacers of molded plastic material at and between the adjacent corners of related tile when the tile are initially laid or set. The cruciform spacers must be removed after the tile are set in place and before grout is deposited in the channels to establish the grout joints.

The above-noted spacers occur within the narrow channels below the top surfaces of the tile and are often so tightly engaged by the tile and/or held by cement that they stubbornly resist removal.

To remove the spacers from between set tile, tile setters have long used common nails as picks and have sometimes used more-comfortable-to-hold and easier-to-manipulate pick tools, such as awls. While such tools are reasonably effective to remove loose spacers, they are notably less effective to remove tightly held and/or stuck spacers. When tightly held or stuck spacers are encountered, they are most frequently left in place with the hope that a small or thin covering of grout will obscrue them. This practice has often been defined as "cheating" and is frowned upon. Such cheating is practiced due to the fact that the great forces that must be exerted and the working of simple pick tools that must be resorted to effect removal of stuck spacers are likely to chip and crack the tile adjacent to the spacers. To "cheat" by leaving difficult-to-remove spacers in place is less time consuming and far less costly than to remove and replace chip or cracked tile.

In the electronics art, when assembling, servicing and/or repairing circuit boards and the like, technicians constantly find it necessary to use pick tools to move delicate and fragile circuit components and parts relative to and about other delicate and fragile components and parts. When performing such work, special care must be taken to avoid forcibly moving the hard metal pick tools into engagement with any part of the circuit structure other than the part sought to be moved. As a result of the above, the technicians must deftly manipulate their pick tools without the aid or assistance of any guiding means or structure. As a result of the foregoing, frequency or protracted use of pick tools is extremely difficult and fatiguing.

To reduce the tendency of ordinary pick tools to damage parts of circuit boards and the like that might be accidentally or incidentally contacted, the prior art has encased the shanks of some pick tools with loose, soft, plastic protective sheaves. While such protective sheaves have proved beneficial, the benefits afforded thereby are extremely limited.

OBJECTS AND FEATURES OF THE INVENTION

It is an object of this invention to provide an improved, manually engagable and operable pick tool that is particularly suited for picking and prying difficult-to-move parts which are in close relationship to other delicate and fragile parts and/or structures without great likelihood of damaging those other parts and structures in the course of manipulating and working the pick tool.

It is an object and feature of the invention to provide a pick tool including an elongate tubular lever arm with front and rear ends and within which an elongate needle-like shaft is slidably engaged. The shaft is movable longitudinally of the arm between a rear, unactuated position where the shaft is fully engaged within and shrouded by the arm to a forward, actuated position where the pointed end of the shaft projects freely from the front end of the arm. The pick tool includes an elongate, soft, flexible and resilient tubular work-engaging bushing at the front end of the arm to safely engage delicate and fragile parts and structures when manually orienting the pick tool relative to work to be picked and through which and from which the shaft projects when it is in its actuated position.

Another object and feature of the invention is to provide an improved pick tool including a lever arm and a relatively shiftable shaft as set forth above and which further includes a soft, flexible and resilient fulcrum block on and projecting radially from the lever arm between the ends thereof. The fulcrum block is such that it can safely engage delicate and fragile parts and structure in close proximity to the piece of work to be picked when manually orienting the pick tool relative to said piece of work.

It is an object and feature of the invention to provide an improved pick tool of the general character referred to above wherein the fulcrum block is shiftable longitudinally of the lever arm to adjust and set the working angle of the pick as desired.

Finally, it is an object and feature of the invention to provide an improved pick tool of the general character referred to above which includes both the above-referred-to work-engaging bushing and fulcrum block.

The above-noted and other objects and features of the invention will be apparent and will be fully understood from the following detailed description of the invention, throughout which description reference is made to the accompanying drawings.

DETAILED DESCRIPTION OF THE INVENTION

Figures 1, 2, 3, 4, 5:
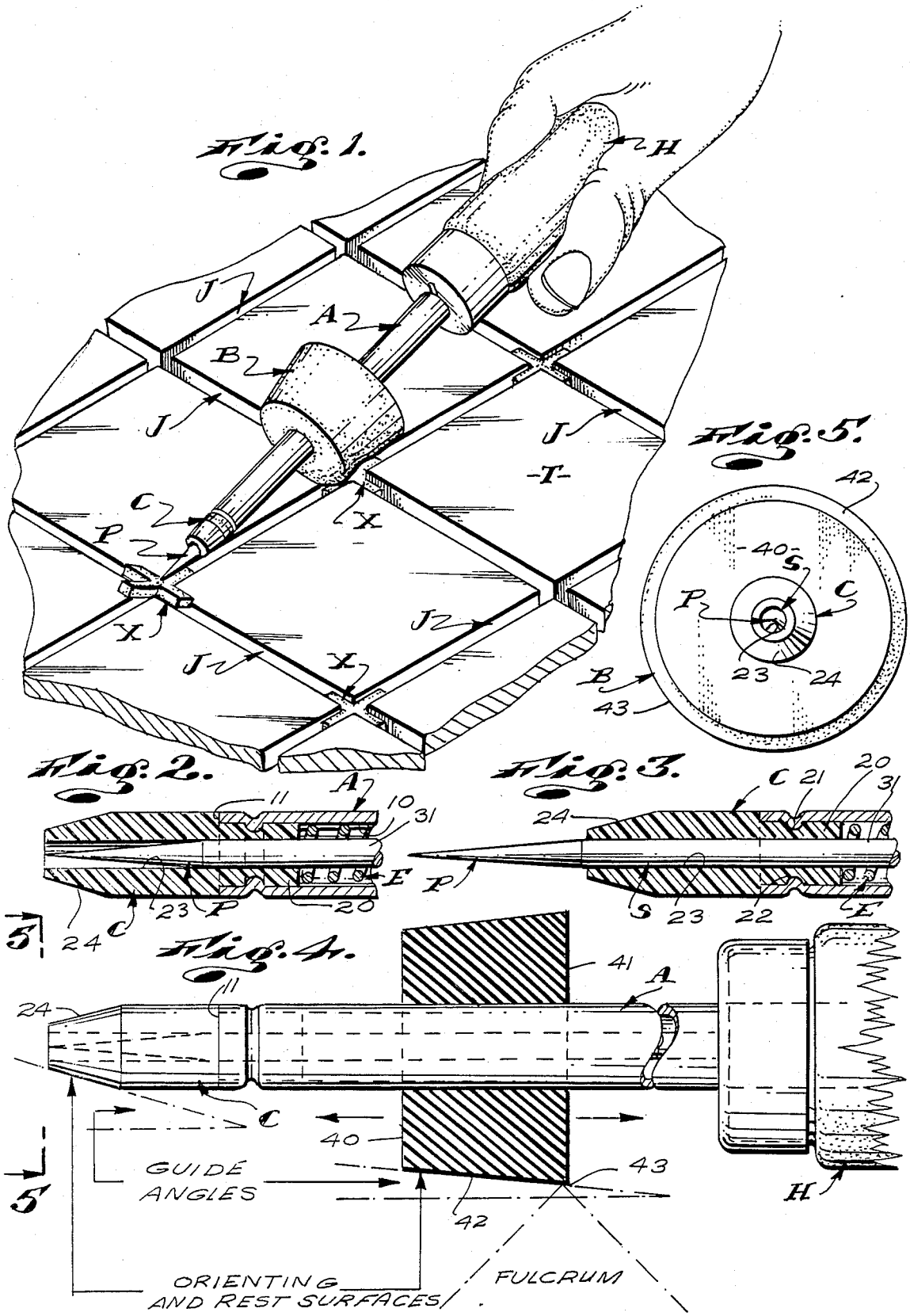
FIG. 1 is an isometric view showing the front, top and one side of the pick tool related to a ceramic tile installation.
FIG. 2 is an enlarged, detailed sectional view of the front work-related end portion of the pick tool shown in FIG. 1, with parts in an unactuated position.
FIG. 3 is a view similar to FIG. 2 showing parts in an actuated position.
FIG. 4 is a side view of the pick tool with the fulcrum block shown in section.
FIG. 5 is an end view taken substantially as indicated by line 5—5 on FIG. 4.
Figure 6:
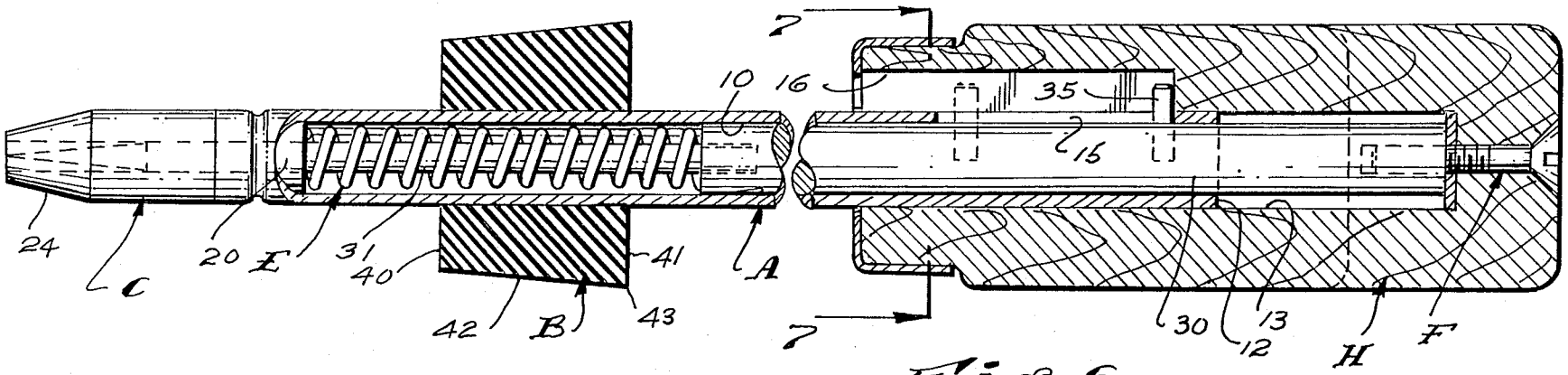
FIG. 6 is a longitudinal sectional view of the whole of the pick structure shown in FIG. 1, in an unactuated position; and, FIG. 7 is a sectional view taken as indicated by line 7—7 on FIG. 6.
Figure 7:
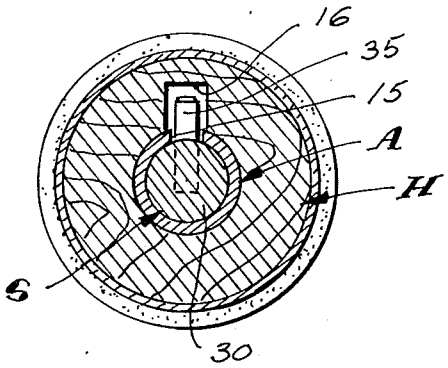

In FIG. 1 of the drawings, I have shown my new pick tool held in the hand of a user and engaged with and removing a cruciform spacer X from within intersecting grout joint channels J defined by a plurality of thin, flat, square ceramic tile T set in fixed spaced and aligned relationship atop a suitable substraight (not shown).

In practice, the tile T are thin, flat, square parts or units with bodies of brittle and fragile ceramic material and with top or surface coatings of thin, brittle and fragile vitrious glaze. The tile are characterized by thin, sharp corners and edges and are such that both their glaze and their bodies are highly subject to being chipped, cracked and/or broken if engaged or struck by any hard, unyielding object, such as a metal pick tool. The forces required to chip or crack the unsupported and unprotected corners and edges of such tile, when contacted by a hard metal pick tool or the like, are surprisingly little.

The grout joint channels between adjacent tile are provided to allow for thermal expansion and contraction and for relative working and/or flexing of the whole of the tile installation without the likelihood of adjacent tile contacting each other and causing damage thereto. The grout joint channels in such installations are filled with a suitable grout or cement which is not as hard and brittle as the tile, but which is sufficiently hard and strong to afford necessary protection and structural support for the corners and edges of the tile to prevent the tile from being chipped and/or broken when put to their normal and intended use.

The cruciform spacers X are engaged between the adjacent corners of related tile, as shown in FIG. 1 of the drawings, to assure that all of the tile in an installation of tile are properly and uniformly spaced apart and so that the grout channels and the grout joints established thereby are uniform and aesthetically pleasing.

The spacers are standard units shaped substantially as shown in FIG. 1 of the drawings. The spacers are most commonly molded of a suitable, inexpensive plastic, such as reclaimed polyvinylchloride with a suitable filler of clay or the like. The spacers are sufficiently soft and flexible so that they will yield and can be extracted from between related tile without damaging the tile and are such that the sharp point of a metal pick tool can be forcibly entered into them in the course of lifting and extracting them from between adjacent related tile.

It is necessary and important that, after tile are set and before the grout joint channels are filled with grout, the spacers be removed so that the channels can be filled with a full depth of grout. If the spacers are not removed, the grout deposited in the channels can only establish a thin, fragile coating of grout over the spacers, which thin coating of grout is highly subject to cracking and flaking off or away from the spacers and rendering the whole of the tile installation defective and unattractive.

While it is intended that the above-noted cruciform spacers X be such that they can be easily and freely picked up and out from between related tile, such is often not the case. In practice, a great percentage of spacers are so tightly engaged and held between the tile that it is necessary that they be pried up and out from engagement between their related tile. The process of prying the spacers up and out of engagement within the grout channels frequently requires that the picking tool used be forcibly worked and jimmied about and that the tool be used as a lifting lever arm, the fulcrum for which must engage and react on portions of adjacent tile. When oridinary picking tools, such as common nails or awls, and forcibly jimmied and/or used as lever arms to pry spacers from engagement between related tile, the tile are all too frequently irreparably damaged and must be replaced. As a result of the above and to avoid the chance of damaging tile in the course of removing spacers, many tile setters will leave in place any spacers that are not removed by a single, relatively light pick with an appropriate picking tool.

My new and improved pick tool is characterized by an elongate, rigid metal lever arm with a work-related front end and a manually-engagable rear end. The rear end can be and is shown provided with a comfortable and convenient-to-engage handle H. Projecting axially forward from the front end of the arm is a forwardly-tapered and sharply-pointed work-engaging portion P of an elongate pick shaft S. Between the front end of the arm A and the handle H is a radially outwardly projecting fulcrum block B of soft, flexible and resilient synthetic rubber or other equivalent material. The fulcrum block B is provided to engage a support surface of a reaction structure, such as the top surface of tile in a tile installation. The block B serves as a fulcrum about which the arm pivots when the pick is used to pry and lift a part, such as a tile spacer, which is engaged by the front work-engaging portion P of the shaft S. The fulcrum block is sufficiently soft, flexible and resilient so that it yieldingly conforms to the shape of the support surface and such that the forces exerted by it onto that surface are spread and widely distributed. The applied forces are sufficiently spread so that high concentrated forces likely to cause damage to the reaction structure are not encountered.

In practice, the shore hardness of the fulcrum block can be varied as circumstances dictate or as the user of the pick tool might prefer.

Further, the fulcrum block B is preferably shiftable longitudinally of the arm so that either or both the mechanical advantage afforded by the block and/or the effective work angle of the tool can be adjusted, as desired or as circumstances require.

Finally, my new pick tool can be and is shown provided with a soft, flexible and resilient work-engaging tubular bushing C. The bushing C surrounds the shaft S and is shiftable longitudinally relative thereto from an unactuated position where it surrounds and shrouds the front porton P of the shaft to an actuated position where the portion P of the shaft is exposed and projects forwardly from the bushing. The bushing C has a thin, tapered, easy-to-deflect, front end portion that will, when moved into engagement with a piece of work or other structure adjacent to the work, yield in advance of and partially conform to the shape of that which it engages. The bushing yields and conforms to that which it engages to an extent that no striking forces are likely to damage the work or other structure. That is, those forces which are directed by the bushing onto the structure the bushing contacts are effectively spread and disbursed.

The bushing C is such that, if deflected and deformed in the manner noted above and the tapered and pointed work-engaging front portion P of the shaft S is moved forwardly therein, the shaft readily straightens the bushing and is free to move to its actuated position where it projects freely forwardly from the bushing and engages the work toward which it is directed.

The bushing C is in the nature of a pilot part which enables the user of the pick tool to easily, safely and conveniently manually position, orient and direct and front end of the tool at and toward a piece of work to be picked prior to the hard metal work-engaging portion P of the shaft S being moved into engagement with the work and without the likelihood of the portion P of the shaft striking and damaging the work or any other structure or part adjacent thereto.

Referring to FIGS. 2 through 7 of the drawings, it will be apparent that in my preferred embodiment of the invention the pick tool includes the structure of an old and conventional spring-loaded pegging awl in or with which my above-noted new and novel fulcrum block B and/or bushing C are incorporated to impart into the old pegging awl structure novel rules of action and new utility.

The new pick tool structure s shown as including the above-noted elongate lever arm A. The lever arm A is a tubular metal part with a cylindrical bore 10 and open front and rear ends 11 and 12. The front end of the arm A is closed by and carries the above-noted bushing C. The rear end portion of the arm is slidably entered in a central, forwardly-opening, longitudinally-extending opening 13 in the handle H and is shiftale longitudinally relative thereto. The rear end portion of the arm occurring witin the handle is formed with an elongate, longitudinally-extending, radially-opening, retaining pin slot 15. The slot 15 is in register with an elongate, longitudinally-extending, retaining-pin-receiving groove 16 formed in the handle H.

The bushing C at the front end of the arm 10 is an elongate, cylindrical part molded of a suitable, soft, flexible and resilient plastic which has a low coefficient of friction with the metal of which the shaft S is made. In practice, the bushing C can be made of Nylon or Teflon.

The bushing C has a cylindrical, plug-like rear portion 20 that is slidably entered into the open front end of the arm. The portion 20 is formed with an annular, radially-outwardly-opening groove 21 in which a retaining bead 22, roll-formed into the arm, is engaged. The groove 21 and bead 22 are but one means one might employ to secure the bushing in engagement with the arm.

The bushing C next includes an elongate, central, longitudinally-extending pilot opening 23, in and through which the shaft S is slidably engaged.

Finally, the bushing C has a radially inwardly and forwardly convergent or tapered front end portion that cooperates with the pilot opening 23 to define a tapered, flexible and resilient, annular work-engaging skirt portion 24 at the front end of the bushing.

The shaft S is an elongate, cylindrical metal part having an elongate large diameter rear end portion 30 with flat front and rear ends. The front end portion of the portion 30 is slidably entered in the rear portion of the arm and the rear portion thereof projects rearwardly from the arm into the opening 13 in the handle to stop at the bottom thereof where it is fixed to the handle by a suitable screw fastener F, as clearly shown in FIG. 6 of the drawings.

The shaft S next includes an elongate, small diameter, central portion 31 that projects forwardly from the rear portion 30 through the arm A to the bushing C where its froward, terminal end porton is slidably entered into the pilot opening 23 to integraly join with the work-engaging front portion P of the shaft.

The rear end portion 30 of the shaft S is provided with and carries a radially-outwardly-projecting retaining pin 35 that projects radially outward through the slot 15 in the arm A and enters the groove 16 in the handle H. The pin 35 and slot 15 cooperate to limit relative longitudinal shifting or movement of the shaft S and handle H relative to the arm A and to prevent displacement of those parts.

The pick tool structure next includes an elongate helical compression spring E engaged about the central portion 31 of the shaft, within the annulus defined by the portion 31 of the shaft and the arm A. The spring has front and rear ends bearing against and acting between the rear end of the bushing C, within the arm, and the front end of the rear portion 30 of the shaft S. The spring normally yieldingly urges the shaft S and the handle H rearward relative to the arm A and in a rear, unactuated position where the forward portion P of the shaft is positioned wholly within the pilot opening 23 of the bushing and is shrouded thereby, as clearly shown in FIGS. 2, 4, 5 and 6 of the drawings.

The spring E yieldingly allows or permits the handle H and shaft S to move forwardly relative to the arm A and bushing C to a forward, actuated position where the forwardly tapered and pointed work-engaging front portion P of the shaft projects freely forwardly from the bushing C, as clearly shown in FIGS. 1 and 3 of the drawings.

Movement of the shaft from its unactuated position to its actuated position occurs when the bushing C and/or the fulcrum block B are engaged and stopped with a piece of work or other supporting and/or reacting structure and when the handle H is manually urged forwardly.

The fulcrum block is an elongate, annular part slidably engaged about the arm A in longitudinal spaced relationship from and between the bushing C and the handle H. The block B can varied widely in size and shape and is shown as having flat, axially-disposed, front and rear ends 40 and 41 and an elongate, longitudinally-forwardly and radially-inwardly-inclned or tapered radially-outwardly-disposed, annular-orienting surface 42. The taper or angle of the orienting surface 42 is such that, when it is aligned and moved into supporting engagement with a flat, supporting surface of a reaction structure, the central longitudinal axis of the pick tool is inclined forwardly and downwardly at a predetermined and convenient-to-work-at angle relative to that flat, supporting surface.

By shifting the position of the block B longitudinally of the arm, the vertical position of the front end of the bushing C above and relative to said supporting surface, when the orienting surface 42 is alinged with and engages the supporting surface, can be effectively adjusted. Such adjusting of the tool can be most advantageous when the tool is set to perform a repetitious picking operation.

In accordance with the above, it will be apparent that the fulcrum block B serves to effectively assist the user of the pick tool to properly manually orient and position the front end of the pick tool relative to a piece of work to be picked, when that piece of work is adjacent to the support surface of the reaction structure with which the block is engaged.

In practice, the taper angle of the orienting surface 42 of the block and the position of the block longitudinally of the arm A is determined by the major outside diameter of the block B and need not, under most circumstances, be moved or adjusted longitudinally of the arm. Adjustment of the position of the block need only be resorted to when the pick structure is or must be set to perform special picking operations. In the case of picking tile spacers from between adjacent related tile, as shown in FIG. 1 of the drawings, the spacers occur well below the top surface or plane of the tile upon which the fulcrum block B of the pick tool rests. With such a special relationship of parts, the position of the block B longitudinally of the arm would preferably be slightly different from that position in which the block is set to most effectively pick work that is positioned atop and/or projects above the supporting surface with which the block is engaged.

It is to be further noted that the inclined orienting surface 42 converges with the rear end 41 of the block B to define a sharp, annular support-surface-engaging fulcrum edge 43, about which the whole of the pick structure pivots when the handle H is urged downwardly to pivotally move the work-related front end of the pick tool upwardly. The taper imparted into the block reduces the body or mass of material in that portion of the block that defines the edge 45 and thereby imparts that portion of the block with greater flexibility and with a greater ability to conform to the shape of the reaction structure surface engaged by the block and to thereby better spread and disburse the forces imposed upon the reaction structure by the block. Though the taper angle might be slight and the reduction of the mass of material defining the fulcrum-edge edge 45 might not appear great, it has been determined that the above-noted effect or the results attained by that taper are notable.

While I have shown and described my new pick tool used to pick and remove cruciform spacers from within the grout joint channels in ceramic tile installations, it is believed to be obvious and apparent that the pick tool is also particularly suited for use in other situations where pick tools are commonly used and where special care must be exercised not to damage delicate and fragile parts in and about the work site. For example, my new pick took is well suited for use by technicians engaged in the assembly, maintenance and manufacture of electric circuit boards and the like where pick tools are commonly used to move and work upon various components and parts and where special care must be exercised not to damage other components and parts that are likely to be damaged if forcibly engaged or struck by a hard, non-yielding pick tool.

Having described only one typical preferred form and embodiment of my invention, I do not wish to be limited to the specific details herein set forth, but wish to reserve to myself any modifications and/or variations that might appear to those skilled in the art and which fall within the scope of the following claims.

Having described my invention, I claim:

1. A pick tool including an elongate, rigid metal lever arm with front and rear ends, a manually-engagable handle at the rear end of the arm, a metal shaft with a forwardly-tapered, sharp, work-engaging front portion at and projecting forwardly from the front end of the arm; and, an annular fulcrum block of soft, flexible and resilient material engaged about the arm in spaced relationship between the front end of the arm and the handle and projecting radialy outward from the arm, the block has an outer annular fulcrum edge to engage and conform to a support surface of a reaction structure at a position spaced from a piece of work engaged by said front portion of the shaft and about which the arm, handle and shaft pivot, an elongate bushing of soft, flexible and resilient material at the front end of the arm, the bushing has a front work-engaging end and has a central, longitudinal pilot opening in which the shaft is slidably engaged, the bushing is shiftable longitudinally of the shaft between a forward, unactuated position where its front work-engaging end is positioned forward of the front end of said front portion of the shaft and a rear, actuated position where its front end is positioned rearwardly from the front end of said work-engaging front portion of the shaft.

2. The pick tool set forth in claim 1 wherein said block is an elongate part with front and rear ends and a radially outwardly disposed, radially inwardly and axially forwardly tapered support-surface-engaging-orienting surface, the orienting surface is arranged parallel with and establishes supporting engagement on a support surface of a reaction structure and orients the tool with the axis of the arm and shaft inclined forwardly and downwardly at a predetermined angle relative to the plane of said support surface, said rear end of the orienting surface converges with the rear end of the block and defines said annular fulcrum edge.

3. The pick tool set forth in claim 1 wherein the forward end portion of the bushing is radially inwardly and longitudinally forwardly inclined and cooperates with the pilot opening to define an annular, forwardly-tapered, flexible, work-engaging skirt portion at the front of the bushing.

4. The pick tool set forth in claim 1 wherein the lever arm is a tubular part, the shaft has an elongate, large diameter, rear end portion with front and rear ends slidably engaged in and shiftable longitudinally within the rear portion of the arm and has an elongate, small diameter, central portion extending longitudinaly freely in the arm and between the front end and rear end portions of the shaft, an elongate, helical compression spring with front and rear ends is positioned in the arm and about the central portion of the shaft with its rear end stopped against the front end of the rear portion of the shaft and with its front end stopped within the arm, said sprig normally yieldingly urges and holds the shaft rearward in the arm and the bushing in its rear, unactuated position relative to the front portion of the shaft.

5. The pick tool set forth in claim 1 wherein the lever arm is a tubular part, the shaft has an elongate, large diameter, rear portion with front and rear ends slidably engaged in and shiftable longitudinally of the rear portion of the arm and has an elongate, small diameter, central portion extending freely longitudinally within the arm and between the front and rear portions of the shaft, an elongate helical compression spring with front and rear ends is positioned in the arm and about the central portion of the shaft with its rear end stopped against the rear portion of the shaft and with its front end stopped within the arm, said spring yieldingly urges and holds the shaft rearward in the arm to a position where said work-engaging front portion of the shaft is wholly within and shrouded by the front portion of the arm.

* * * * *